US007252163B2

(12) United States Patent
Ollerenshaw et al.

(10) Patent No.: US 7,252,163 B2
(45) Date of Patent: Aug. 7, 2007

(54) DOWNHOLE UNDER-REAMER TOOL

(75) Inventors: Andrew Ollerenshaw, Sheffield (GB); Mark Russell, Sheffield (GB)

(73) Assignee: Toolbox Drilling Solutions Limited, Scotland (GB)

( * ) Notice: Subject to any disclaimer, the term of this patent is extended or adjusted under 35 U.S.C. 154(b) by 223 days.

(21) Appl. No.: 11/066,691

(22) Filed: Feb. 25, 2005

(65) Prior Publication Data

US 2006/0144623 A1 Jul. 6, 2006

(30) Foreign Application Priority Data

Jan. 4, 2005 (GB) ..... 0500019.5

(51) Int. Cl.
*E21B 7/28* (2006.01)
*E21B 10/30* (2006.01)

(52) U.S. Cl. ..... 175/269; 175/406

(58) Field of Classification Search ..... 175/269, 175/406, 284, 267
See application file for complete search history.

(56) References Cited

U.S. PATENT DOCUMENTS

| | | | | |
|---|---|---|---|---|
| 1,921,135 | A * | 8/1933 | Santiago | 175/269 |
| 3,123,162 | A * | 3/1964 | Rowley | 175/325.4 |
| 4,407,377 | A | 10/1983 | Russell | |
| 4,889,197 | A | 12/1989 | Boe | |
| 5,065,825 | A | 11/1991 | Bardin et al. | |
| 5,310,012 | A | 5/1994 | Cendre et al. | |
| 5,392,867 | A | 2/1995 | du Chaffaut et al. | |
| 5,437,308 | A | 8/1995 | Morin et al. | |
| 5,452,772 | A | 9/1995 | Van Den Bergh | |
| 5,483,987 | A | 1/1996 | Amaudric du Chaffaut | |
| 6,213,226 | B1 | 4/2001 | Eppick et al. | |
| 6,289,999 | B1 | 9/2001 | Dewey et al. | |
| 6,378,632 | B1 | 4/2002 | Dewey et al. | |
| 6,615,933 | B1 | 9/2003 | Eddison | |
| 7,048,078 | B2 | 5/2006 | Dewey et al. | |
| 2003/0155155 | A1 * | 8/2003 | Dewey et al. | 175/57 |

FOREIGN PATENT DOCUMENTS

| | | |
|---|---|---|
| WO | WO 00/53886 | 9/2000 |

* cited by examiner

*Primary Examiner*—David Bagnell
*Assistant Examiner*—David Andrews
(74) *Attorney, Agent, or Firm*—Keeling Patents and Trademarks L.L.C.

(57) ABSTRACT

A downhole tool comprises a body having slots communicating the outside of the body with the body through-bore. A sleeve actuator and mandrel are selectively axially slidable. The actuator has flanges extending into the slots. The flanges have ribs on their sides that are inclined at an acute angle to the longitudinal axis of the tool. Hollow bars are slidable in the slots and they have channels inside corresponding with, and engaged in, the ribs of the flanges. The sleeve actuator slides in the body between a tool actuated position and a tool deactuated position. The mandrel is selectively axially slidable between a tool actuated position, an interlock position and a sleeve-lock position. A lock ball locks the sleeve actuator with respect to the body in the tool deactuated position and while the mandrel is between the interlock and sleeve-lock positions. The lock ball also locks the sleeve actuator with respect to the mandrel while the mandrel is between said interlock and tool actuated positions.

40 Claims, 5 Drawing Sheets

10
12b
20b
50
14
12
94
100
98
92
31
63
96
64
67
90
32
40a
36a
38
30
60
3a
44
58
34a
116
88
65
70
68
66
62
72
12a
18a
20a
22
18
16
24
84a
86b
82
86a
86c
74
114
34e
34d
102
3b
84

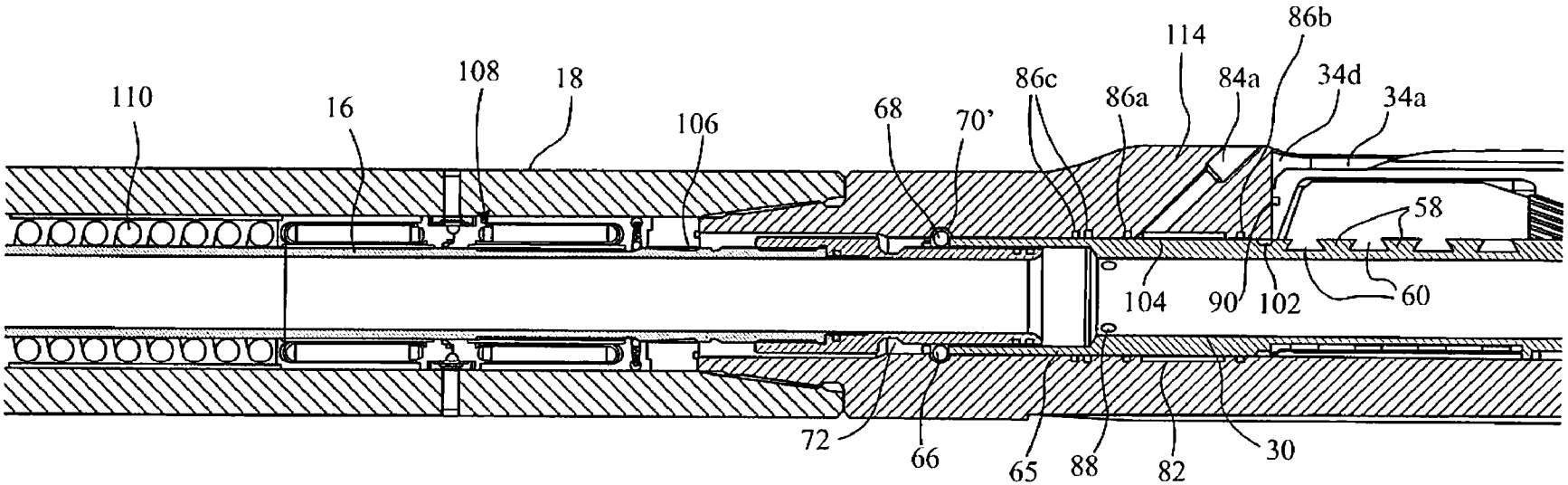
Fig. 2a1

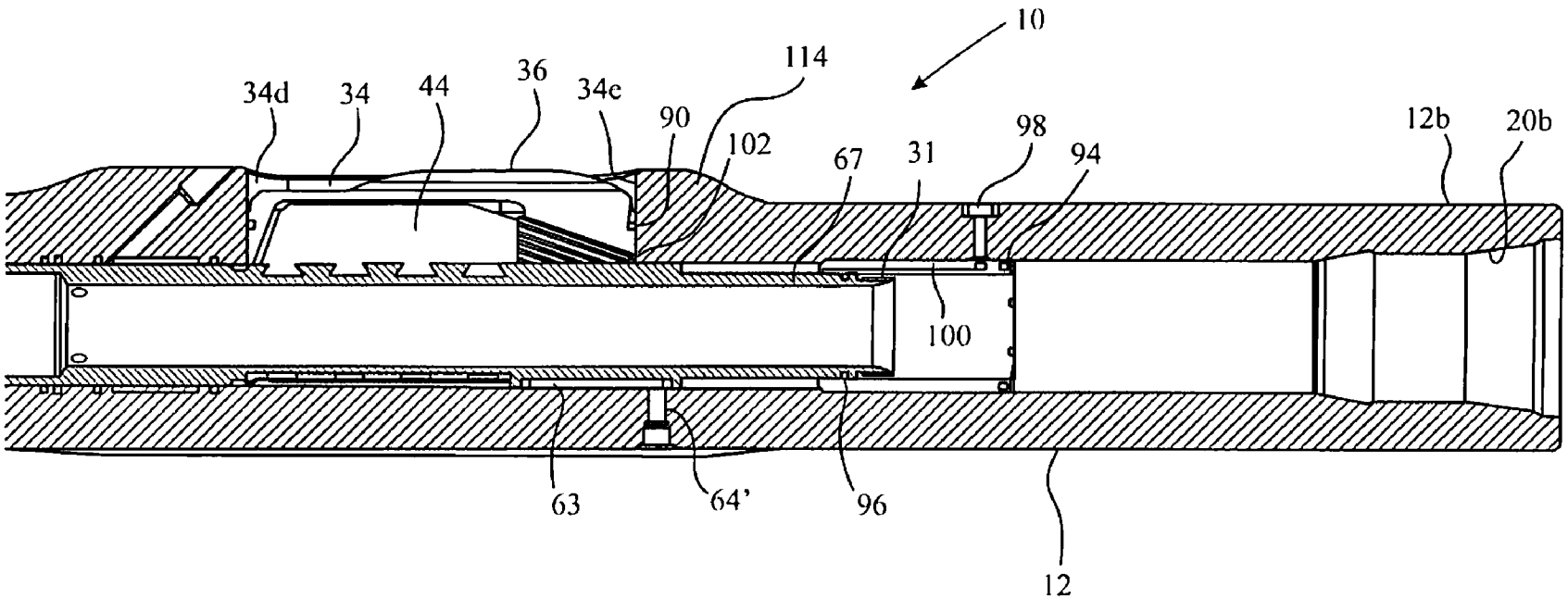
Fig. $2a_2$

DOWNHOLE UNDER-REAMER TOOL

CROSS-REFERENCE TO RELATED APPLICATIONS

This application claims the benefit of foreign application number GB 0500019.5, filed in Great Britain on Jan. 4, 2005.

STATEMENT REGARDING FEDERALLY SPONSORED RESEARCH OR DEVELOPMENT

Not Applicable.

BACKGROUND OF THE INVENTION

FIELD OF THE INVENTION

The present invention relates to a downhole tool, in particular an under-reamer.

Under-reamers are employed to widen a bore hole behind a drill bit, particularly after a bore hole has been cased with a liner and the drill bit is necessarily of smaller dimension than the casing in place. It is desirable to maintain the maximum possible dimension of the hole under the casing so that, when the new hole is complete, a casing for the new hole need only be marginally smaller than the existing casing, sufficient to allow it to pass through the existing casing into the new hole. However, if the new hole has the same, or rather smaller, dimension, than the existing casing, then such wide casing as will fit in the existing casing is most likely to be too big to slide smoothly inside the new hole, which may be somewhat rough and fractured rock.

In this event, an under-reamer having a first dimension small enough to fit inside the existing casing is employed and, when it follows the drill bit to below the bottom of the casing, is expanded to a second, larger dimension and begins reaming the bore wall.

Under-reamers are well known and come in different forms. One form has pivoting arms, on the ends of which are cutting elements. Another form has expanding arms deployed in a similar way to stabiliser bars of adjustable stabilisers. That is to say, they are pressed outwardly by piston like elements actuated by an inclined ramp on a mandrel moving axially in relation to the tool.

EP-A-595420 and GB-A-2385344 both disclose under-reamers in which bars are supported in slots in the body of the tool, the slots being provided with inclined channels mating with corresponding ribs on the bars. By urging the bars axially by means of a mandrel, the bars move not only axially in the slots, but also radially. This arrangement has the advantage that the radial dimension of the bars and their actuation mechanism is minimised, whereby the remaining radial dimension of the tool is not encumbered and can be left open for the relatively uninhibited transmission of drilling fluid (mud) to the drill bit below.

However, a disadvantage of this arrangement is that the slots and their channels, and their interaction with the actuating mechanism is exposed to the drilling fluid, and the opportunity exists for obstruction, or, at the very least, excessive wear, of the relatively moving components.

A convenient and common mechanism for operating downhole tools comprises a mandrel operated by hydraulic pressure of the drilling fluid and moving axially in the tool to a greater or lesser extent. Various actuation mechanisms exist.

WO-A-00/53886 discloses one such arrangement where a mandrel is driven axially in the bore of the body against the pressure of a return spring, a control piston also being driven against the pressure of a second return spring and rotating a sleeve positioned between the mandrel and a shoulder of the body. Depending on the rotational position of the sleeve, which is provided with castellations facing corresponding castellations on one of the mandrel and body, the extent of the movement of the mandrel is controlled. When the castellations oppose one another, the mandrel is prevented from moving a significant distance, whereas, when they interdigitate, the mandrel can move a full amount. In moving a full amount, the tool (in this case a stabiliser) is actuated. In not moving the full amount, the tool is not actuated. The piston rotates by reason of a barrel cam on the piston, and a pin fixed in the body. A track of the barrel cam rotates the piston, and hence the sleeve, when it moves axially back and forth as the mud pressure is alternately raised and lowered. Consequently, with each change of fluid pressure, the tool is actuated and deactuated.

U.S. Pat. No. 5,483,987 and U.S. Pat. No. 6,289,999 both disclose a barrel cam arrangement where cycling of the fluid flow from low pressure/no-flow to high pressure/full-flow does not alter the actuation position of the tool (in the former patent, the actuator operates by fluid flow, rather than by pure fluid pressure, but the principle is the same). Only if the fluid flow or pressure is reversed at an intermediate flow or pressure can the track of the barrel cam be changed so that it can move to an actuation position.

By the nature of the conditions pertaining downhole, when such a tool as an under-reamer is being operated, it is frequently the case that fluid flow is cycled without there being any desire to actuate the tool. Thus the arrangements of the just-mentioned patents are useful. However, both these documents relate to arrangements in which the actuation position of the mandrel is such as to create a pressure drop across a tool actuation mechanism, the actuation being effected by a separate mechanism employing such pressure drop.

Where the mandrel itself actuates the tool, it would be desirable to isolate control movements of the mandrel from actuating strokes thereof.

BRIEF SUMMARY OF THE INVENTION

Thus it is an object of the present invention to provide a tool that overcomes the disadvantages discussed above, or at least mitigates their effects.

In accordance with a first aspect of the present invention, there is provided a downhole tool comprising:

a body having a longitudinal axis and a body through-bore, a slot communicating the outside of the body with the body through-bore;

a sleeve actuator mandrel having a sleeve actuator mandrel through-bore and being selectively axially slidable in the body through-bore;

a flange on the sleeve actuator mandrel extending into said slot and having one of ribs and channels formed on its sides and inclined at an acute angle to the longitudinal axis; and a hollow bar slidable with a radial component in the slots, the other of channels and ribs being formed on the bar and corresponding with, and engaged in, said one of said ribs and channels of the flange.

The advantage of the first aspect of the present invention is that the actuating surfaces of the tool, namely the interengaging ribs and channels, are isolated from the drilling fluid.

Preferably, seals between said sleeve actuator mandrel and body beyond both ends of said slots define, between them and seals around the bars in the slots, a chamber enclosing lubricating oil. In this event, the mutually engaging surfaces are primarily within the confines of the oil chamber, where they are not only protected from contamination by drilling fluid and debris, but also they are washed in lubricant to facilitate their movement and to reduce wear.

In accordance with a second aspect of the present invention, there is provided a downhole tool comprising:

a body having a longitudinal axis and a body through-bore, the body mounting an actuatable tool;

a sleeve actuator having an actuator through-bore and being axially slidable in the body through-bore between a tool actuated position and a tool deactuated position;

a mandrel having a mandrel through-bore and being selectively axially slidable in the body through-bore between a tool actuated position, an interlock position and a sleeve-lock position; wherein:

an extension of the mandrel is a close sliding fit inside a first end of the sleeve actuator;

said first end captivates a lock element;

said body has an internal groove positioned so that, when said sleeve actuator is in said tool deactuated position, said lock element is aligned with said groove and held in engagement therein by said extension while the mandrel is between its interlock and sleeve-lock positions; and said mandrel has an external recess positioned so that, when said mandrel is in said interlock position, said lock element is aligned with said recess, whereupon movement of the mandrel towards said tool actuated position releases said lock element from said groove permitting said sleeve actuator to be moved by the mandrel to said tool actuated position, said mandrel and sleeve actuator being locked together by the body holding said lock element in said recess between said interlock and tool actuated positions of the mandrel.

Put another way, said second aspect of the present invention provides a downhole tool comprising:

a body having a longitudinal axis and a body through-bore, the body mounting an actuatable tool;

a sleeve actuator having an actuator through-bore and being axially slidable in the body through-bore between a tool actuated position and a tool deactuated position;

a mandrel having a mandrel through-bore and being selectively axially slidable in the body through-bore between a tool actuated position, an interlock position and a sleeve-lock position; wherein:

first means lock the sleeve actuator with respect to the body in said tool deactuated position and while said mandrel is between said interlock and sleeve-lock positions; and second means lock the sleeve actuator with respect to the mandrel and while said mandrel is between said interlock and tool actuated positions.

In this respect, said first and second means may comprise a lock element captivated by the sleeve actuator and located in one of a groove in the body or a recess on the mandrel. Alignment of said groove and recess occurs in said interlock position of the mandrel, which coincides with said tool deactuated position of the sleeve actuator.

Preferably, said first and second aspects are combined together, in which event, said sleeve actuator mandrel of the first aspect comprises the combination of said sleeve actuator and mandrel of the second aspect.

The advantage of the second aspect is that the sleeve actuator is only required to move between the two positions between which the tool actuates and deactuates and not beyond. Consequently, necessary movements of the mandrel while its actuation is switched or adjusted, depending on its form, do not lead to redundant movements of the sleeve actuator. Alternatively, the mandrel control movements are not required to occur during actuating and deactuating movements of the tool. This is a particular advantage when used in a tool according to the first aspect of the present invention, since the sleeve actuator of necessity has only a limited axial movement.

A further advantage is that a return mechanism is required to guarantee that the bars return to their deactuated position when this is selected. Usually, the strongest mechanism is required to actuate tools, because this will generally involve contact with the hole bore (to start cutting, for example, with an under-reamer), whereas retraction is generally not opposed. On the other hand, when components get worn or contorted by their interaction with the bore hole, they may be difficult or impossible to withdraw.

This might be very problematic with an under-reamer where, to get the tool out through a narrow casing above the reamer, the reamer must be withdrawn (deactuated). Generally, a strong return spring is needed for this and, by connecting the mandrel with the sleeve actuator, the return spring for the mandrel can also serve as the return spring for the tool. Since it is normal to provide signalling in the form of pressure pulses, at least when the tool is actuated, then, by connecting the mandrel to the tool actuator, signalling by the mandrel equates to signalling by the tool, at least when they are interconnected.

Preferably, said sleeve actuator mandrel has a port therethrough which aligns with a jet in the body when the sleeve actuator mandrel is in its tool actuated position, whereupon the through-bore of the sleeve actuator is in fluid communication with said jet, and whereby drilling fluid under pressure in said mandrel through-bore is directed onto the well bore in the region of said bar.

Indeed, the applications of the present invention are not limited to under-reamers. Adjustable stabilisers could benefit from both aspects of the invention.

Circulating subs could benefit from the second aspect. In this event, said sleeve actuator has ports therethrough which align with jets in the body when the sleeve actuator mandrel is in its tool actuated position, whereupon the through-bore of the sleeve actuator is in fluid communication with said jets, and whereby drilling fluid under pressure in said body through-bore is directed into the well bore. At the same time, a valve may be operated by the sleeve actuator to restrict drilling fluid flow through the tool past said jets.

Preferably, there are a plurality, preferably three, of said bars, slots and flanges spaced around the longitudinal axis of the tool.

Where the tool is an under-reamer, said bars are provided with cutting elements to effect under-reaming when the tool is actuated in a well bore having a pilot hole receiving the tool.

Preferably, said body is thickened in the region of said slots and bars to support said bars. The body may have fins ahead of said slots having dimensions to match said pilot hole and bear against its surface and stabilise the tool, in use, said fins being provided with a hardened wear surface to minimise wear.

Alternatively, the tool may be an adjustable stabiliser, said bars being provided with hardened wear surfaces to minimise wear of the bars, in use.

Furthermore, the tool may be an azimuth controller, in which one or more bars in one or more slots are arranged asymmetrically around the longitudinal axis of the tool. The tool may also comprise one or more static blades.

Other features and advantages of the invention will be apparent from the following description, the accompanying drawing and the appended claims.

DESCRIPTION OF THE INVENTION

Figures 1A, 1B, 1C:
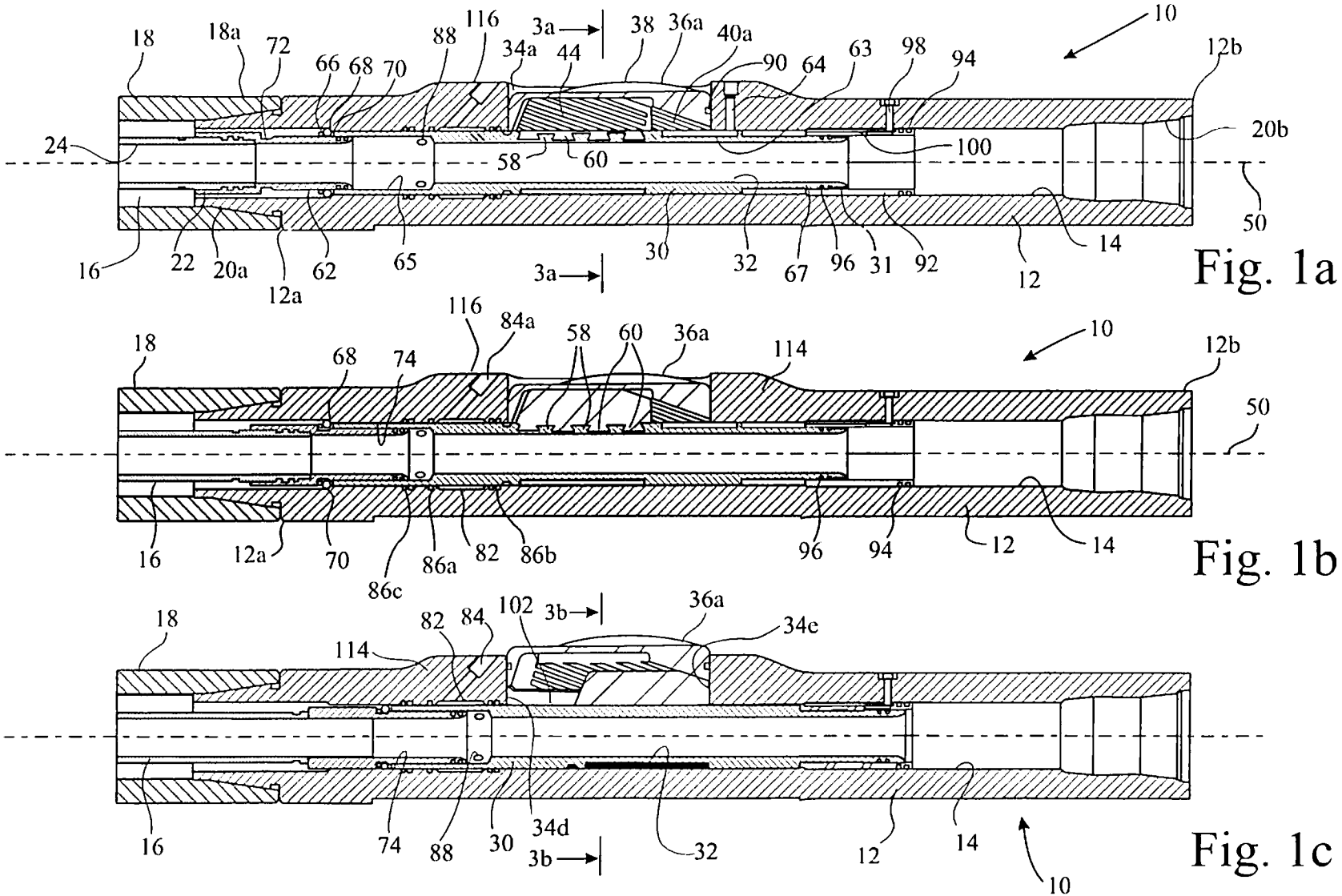
FIGS. 1*a, b* and *c* are side sections through an under-reamer in accordance with the present invention in sleeve lock, interlock and tool actuated positions respectively.

In the drawings, an under-reamer 10 comprises a body 12 having a through-bore 14 along a longitudinal axis 50 of the tool 10. A mandrel 16 actuates the tool 10 and is a component of an actuation mechanism 18, only one end of which is shown in the drawings. The actuation mechanism 18 is connected at its end 18*a* to end 12*a* of the body 12 by a standard screw thread connection 20*a*. The other end 12*b* of the tool 10 comprises a female connection 20*b*.

The actuation mechanism 18 forms no part of the present invention and may be in the form disclosed in WO-A-00/53886, U.S. Pat. No. 5,483,987, U.S. Pat. No. 6,289,999 (the entire disclosures of which are incorporated herein by reference), or any suitable means. Connected to the end of the mandrel 16 is mandrel end 22, which, conveniently, is screw threaded to the mandrel 16. However, in suitable circumstances end 22 may be integral with the mandrel 16 and henceforth is considered a part of the mandrel 16. In the drawings, mandrel 16, and its end 22, is shown in three positions. In FIG. 1*a*, it is shown in a sleeve-lock position. In FIG. 1*b*, it has moved axially rightwardly in the drawings to an interlock position and, in FIG. 1*c*, it has moved further rightwardly to a tool actuated position. The above positions are described further below.

The tool 10 further comprises a sleeve actuator 30 which also has a sleeve through-bore 32. Therefore, it can be seen that a clear passage comprising mandrel through-bore 24, sleeve through-bore 32, and body through-bore 14 through the tool 10 permits unimpeded passage of drilling fluid to a drill bit (not shown) connected to the tool 10.

Neither end 12*a,b* of the tool 10 is necessarily nearer the drill bit. However, for reasons explained further below, in the present arrangement, end 12*a* of the tool 10 is preferably arranged nearest the drill bit.

The body 12 is provided with three axially disposed, circumferentially spaced slots 34*a,b,c*, only 34*a* of which is visible in FIGS. 1*a* to 1*c*. Each slot receives a radially slidable cutter bar 36*a,b,c*. Although radial, there is no reason why the axis of the slots 34 should not be inclined to the radial. The top surface 38 of each cutter bar is provided with cutting elements, further details of which are not given herein. Suitable form of cutting elements will be known to those skilled in the art. One arrangement is shown in U.S. Pat. No. 6,732,817 (the full disclosure of which is herein incorporated by reference). Each cutter bar 36 is hollow, with an interior space or pocket 46. The interior sides 40*a,b* (which sides are parallel the longitudinal axis 50) are formed with ribs 42 which are inclined with respect to the axis 50.

The actuator sleeve 30 is provided with three flanges 44*a,b,c* which are received within the pockets 46 of the hollow bars 36. The flanges 44 are each provided with channels 48 which are also inclined with respect to the longitudinal axis 50 and which cooperate with the ribs 42 in the sides 40*a,b* of the pocket 46. Indeed, the channels 48 define ribs between them, as do the ribs 42 define channels between them.

With reference to FIGS. 3*a* and *b*, the actuator sleeve 30 has, on its external surface, three open sections 52*a,b,c*. On assembly of the tool 10, these sections are aligned with the slots 34*a,b,c* respectively. Each bar 36 with its corresponding flange 44 is then inserted through the slots 34 until a dovetailed base of the flanges 44 abut the open sections 52. The actuator sleeve 30 is also provided with three dovetail sections 56*a,b,c* disposed between each open section 52*a,b,c*. When correctly aligned, the sleeve 30 is rotated through 60° about the longitudinal axis 50. An hexagonal section of a nose 31 at second end 67 of the sleeve actuator 30 is adapted to receive a tool for this purpose. Dovetails 58 on the dovetailed sections 56 of the sleeve actuator 30 then lock with corresponding dovetails 60 on the dovetailed base of the flanges 44. In this way, the flanges 44 are locked to, and become an integral part of, the actuator sleeve 30. However, it is required to ensure that the sleeve 30, in operation, does not rotate about axis 50 relative to the slots 34, otherwise this will disengage the dovetails 58, 60. For this purpose, a drilling 64 (64' in FIG. 2*$a_2$*) in the body 12 is adapted to receive a pin (not shown) adapted to slide in a longitudinal groove 63 on the surface of the sleeve 30. Thus the sleeve 30 is constrained rotationally about the longitudinal axis 50 but is free to move axially.

When the actuator sleeve 30 does move axially, as it does between the positions shown in FIGS. 1*b* and 1*c*, the ribs/channels 42,48 on the flanges 44 and inside the bars 36 interact to radially displace the bars 36 from a stowed, deactuated position (as shown in FIGS. 1*a* and *b*), and where the bars are within the confines of the slots 34, to an actuated position as shown in FIG. 1*c*. Here, the bars 36 can bear against and cut the well bore (not shown).

The actuator sleeve 30 is controlled by the mandrel 16. The mandrel end 22 has a cylindrical extension 62 which is a close sliding fit in sleeve 30 at its first end 65. On the end 65 are formed a number of pockets 66 which each receive a lock element in the form of a ball 68. A shoulder 70 is provided in the body 12 and the lock elements 68, sitting on the cylindrical surface of the extension 62, prevent the sleeve 30 from moving rightwardly by engaging the shoulder 70. The sleeve is therefore in a sleeve-lock position because the lock elements 68 prevent any rightward movement of the sleeve 30, while the flanges 44 are at their leftmost position, in which the bars 36 fully withdrawn into the slots 34.

In this position, the mandrel 16 is free to move between the positions shown in FIG. 1*a* and the position shown in FIG. 1*b* without affecting the position of the sleeve 30. However, when the mandrel 16 is moved rightwardly to an interlock position as shown in FIG. 1*b*, recesses 72 on the surface of the mandrel extension 62 align with the lock elements 68. They are consequently released from engagement with the shoulder 70. Now, further rightward movement of the mandrel moves the actuator sleeve 30 rightwardly in the drawing to actuate the bars 36.

Between the interlock position shown in FIG. 1*b* and the tool actuated position shown in FIG. 1*c*, the internal cylindrical surface 74 of the body 12 locks the lock elements 68 in the recess 72 of the mandrel. Thus, the mandrel is locked to the actuator sleeve 30. Consequently, when the mandrel returns leftwardly in the drawings from the FIG. 1*c* position, the actuator sleeve 30 is constrained to follow it.

Figure 2B:
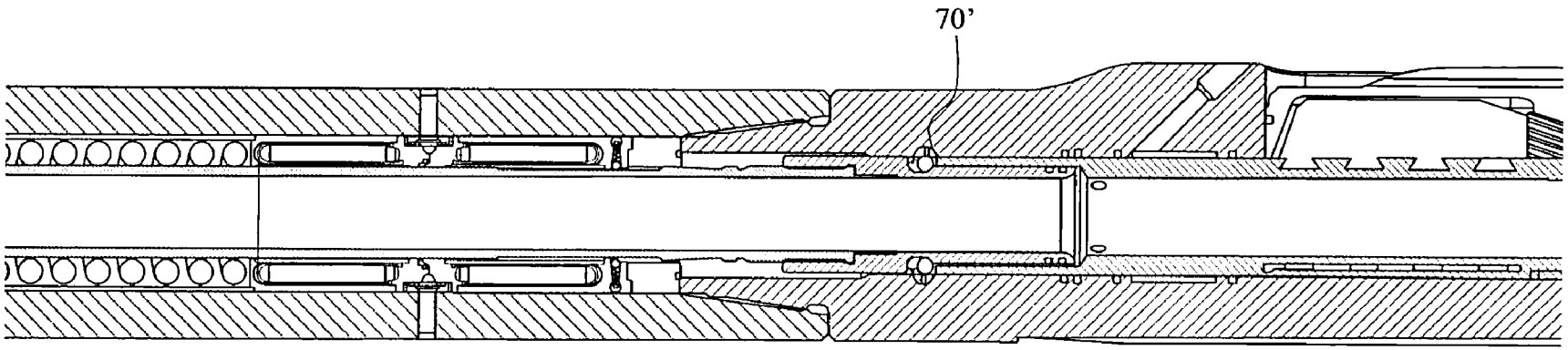
FIGS. 2*$a_1$, $a_2$, b* and *c* are views of a variation of the tool shown in FIGS. 1*a* to *c*, in corresponding positions, but also in greater detail; and, FIGS. 3*a* and 3*b* are sections along the lines 3*a*-3*a* and 3*b*-3*b* in FIGS. 1*a* and 1*c* respectively.
Figure 2C:
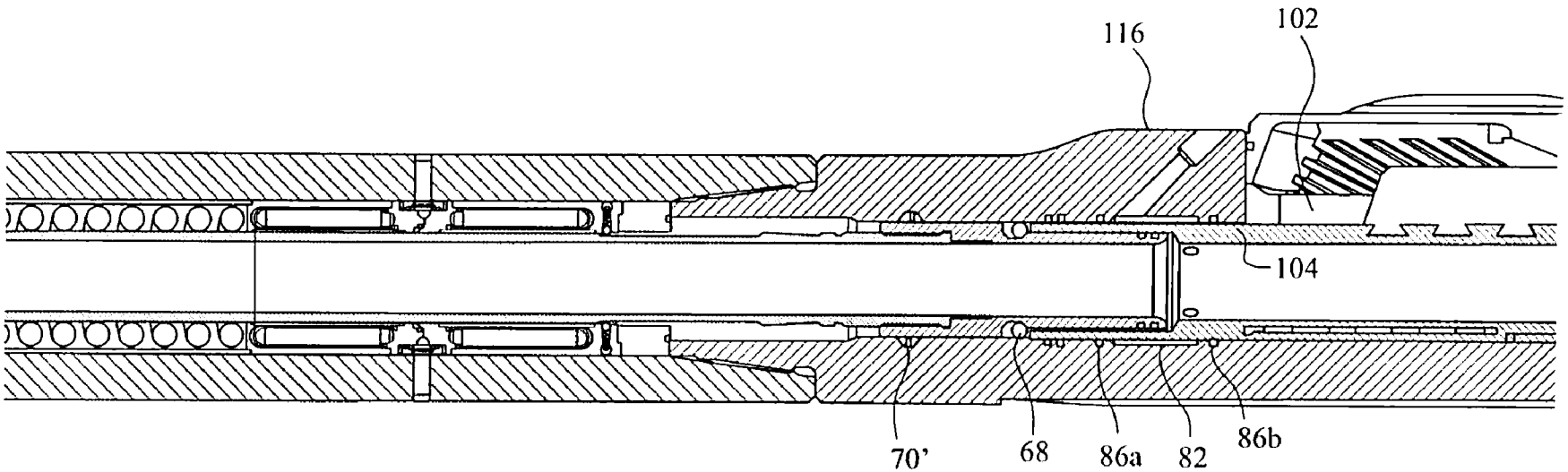

This arrangement is also shown in greater detail in FIGS. 2*a* to *c*. A difference, however, between the embodiment shown in FIGS. 1*a* to *c* is that, here, the shoulder 70 is replaced by a circumferential groove 70'.

A circumferential gallery 82 is provided around the body bore 14, adjacent the ends of the slots 34. Each slot 34 has an associated jet 84*a,b,c* (only jet 84*a* being visible in the drawings). The jets 84 communicate with the gallery 82. The gallery 82 is sealed to the external surface of the sleeve 30 by seals 86*a,b*. The sleeve 30 is provided with a number of apertures or ports 88. These put the sleeve bore 32 in fluid communication with its external surface. In the deactuated position of the actuator sleeve 30 (FIGS. 1*a* and 2*a*$_1$), the apertures 88 are sealed by seals 86*a* and further seals 86*c* in the body bore 14. However, when the actuator sleeve 13 moves into its actuated position as shown in FIGS. 1*c* and 2*c*, the ports 88 communicate with the gallery 82 so that drilling fluid under pressure in the actuator sleeve bore can escape to the outside through the ports 88, gallery 82 and jets 84. In issuing from the jets 84, the drilling fluid serves to clear debris caused by the action of the cutters 36 against the well bore.

Each slot 34 is not rectangular in section but has rounded ends 34*d*, 34*e*. The bars 36 are correspondingly rounded at their ends and a circumferential groove 90 is formed around the entire periphery of each bar in which a seal (not shown) is disposed.

At its second end 67, the sleeve 30 is received within a liner 92 of the body 12. The liner 92 is sealed to the body 12 by seal 94 and the end 67 is sealed to the liner by seal 96. Thus, between the seals 86*b*, seals 94,96, and seals 90 around the bars 36, an oil chamber 102 is defined. This can be filled with lubricating oil through a tapping 98 and longitudinal groove 100 in liner 92. In use and after filling, tapping 98 is plugged by means not shown.

Thus the interacting surfaces of the flanges 44 and bars 36 (that is to say, the ribs/channels 42,48), as well as the external surfaces of the bars 36 against the slots 34, and the sliding of the sleeve actuator 30 in the body through-bore 14, are all facilitated by the lubrication. This serves to reduce wear. Also, drilling fluid, particularly that in the annulus surrounding the tool 10 inside the well-bore, is isolated from these components so that the risk of jamming by hard particles carried by the drilling fluid is reduced.

However, it will be appreciated that the volume of the chamber 102 changes as the radial position of the bars 36 changes, not to mention the axial position of the sleeve actuator 30. Therefore, several longitudinally arranged drillings 104 are spaced around the circumference of the end 65 of the sleeve actuator 30. These are positioned both to avoid the ports 88 and the pockets 66 and therefore should not strictly be visible in the drawings. However, they are shown in FIGS. 2*a*$_1$, *b* and *c* for illustrative purposes.

Drillings 104 connect the chamber 102 with the annulus 106 in actuation mechanism 18 and surrounding mandrel 16. The pressure in the annulus 106 is released by a bladder arrangement 108, further details of which are not given as its essential structure is well understood in the art.

The drillings not only relieve pressure in the chamber 102 but also serve to damp movement of the sleeve actuator 30. They also supply the interlock arrangement 72,68,70 with lubricant to facilitate its action as well.

Beyond the pressure relief bladder arrangement 108, a mandrel return spring 110 is visible. Although not shown completely, spring 110 acts between bladder 108 fixed in the body of mechanism 18 and a shoulder on the mandrel 16, urging it leftwardly in the drawings (see FIG. 2*a*$_1$).

As mentioned above, the direction of orientation in a well bore of the tool 10 is not absolutely determined by its structure: it will operate in either direction; at least, it will if the actuation mechanism 18 operates on fluid pressure. However, it is preferred that it be arranged with the end 12*a* closest to the drill bit for three reasons. The first is that the jets 84 are more effective being directed immediately at the cutting interface between the cutters 36 and the well bore. Secondly, in the event that the bars 36 (or one of them), jam in their slots 34 and the normal deactuation force applied by the mandrel return spring is inadequate to overcome the jamming, then pulling the tool 10 up against the under edge of the casing (not shown) is considered more likely to nudge the jammed bar(s) back into the slots 34 than from the other direction. Thirdly, in the event of jamming, it would be possible to drop a ball down the well bore so that it closes the end of nose 31 of the sleeve actuator 30. Then, hydraulic pressure above the actuator can supplement the force applied by the mandrel return spring 110.

It is to be noted that there are shown in the drawings three circumferentially spaced bar/flange/slot combinations around the tool. This is for illustrative purposes. The invention includes the possibility of more or less. The possibility of a tool with just one bar exists in the application of an azimuth controller, where it is desired to deflect the drillstring to one side of the well bore so that the azimuth of a motor assembly in the string may be adjusted.

In the case of a stabiliser, the bars 36 are not provided with cutting elements, as shown, but with hardened wear surfaces.

The body 12 is provided with thickened regions 114 12 to support the slots 34 and bars 36. From another perspective, the tool has thinned regions, where the extra thickness of the body is not required!

In the case of the under-reamer, the thickened regions 114 ahead (in the drilling direction) of the slots 34 have an enlarged diameter surface 116 which is provided with hardened wear elements. In use, the tool here bears against the pilot hole formed by the drill bit on the end of the drill string (not shown) and stabilises the under-reamer keeping it central with respect to the pilot hole.

The foregoing description of the invention illustrates a preferred embodiment thereof. Various changes may be made in the details of the illustrated construction within the scope of the appended claims without departing from the true spirit of the invention. The present invention should only be limited by the claims and their equivalents.

What is claimed is:

1. A downhole tool comprising:

a) a body having a longitudinal axis and a body through-bore, a slot communicating the outside of the body with the body through-bore;

b) a sleeve actuator mandrel having a sleeve actuator mandrel through-bore and being selectively axially slidable in the body through-bore;

c) a flange on the sleeve actuator mandrel extending into said slot and having one of ribs and channels formed on its sides and inclined at an acute angle to the longitudinal axis;

d) a hollow bar slidable with a radial component in the slot, the other of channels and ribs being formed on the bar and corresponding with, and engaged in, said one of said ribs and channels of the flange, and e) seals between said sleeve actuator mandrel and body beyond both ends of said slot, and a seal around the bar in the slot, which seals define between them a chamber enclosing lubricating oil.

2. A downhole tool according to claim 1, wherein said sleeve actuator mandrel has a port therethrough which aligns with a jet in the body when the sleeve actuator mandrel is in its tool actuated position, whereupon the through-bore of the sleeve actuator is in fluid communication with said jet whereby drilling fluid under pressure in said mandrel through-bore is directed onto the well bore in the region of said bars.

3. A downhole tool according to claim 1, wherein the axis of the slot is radial with respect to said longitudinal axis.

4. A downhole tool according to claim 1, wherein said flange is separate from the sleeve actuator mandrel but is locked thereon by circumferential dovetailed slots formed on a sector of the sleeve actuator mandrel adjacent an open sector thereof, and corresponding dovetails on the base of said flange engaged with said dovetailed slots of the sleeve actuator mandrel.

5. A downhole tool according to claim 4, wherein the tool is assembled by inserting said flange engaged with said bar in said slot so that said dovetails bear against said open sectors of the sleeve actuator mandrel, and by rotating said mandrel so that said dovetail slots engage said dovetails, means being provided to prevent the sleeve actuator mandrel from rotating in the body during use.

6. A downhole tool according to claim 5, wherein said rotation prevention means comprises a pin in the body extending into a slot in the sleeve actuator mandrel.

7. A downhole tool according to claim 1, wherein there are a plurality of said bars, slots and flanges spaced around the longitudinal axis of the tool.

8. A downhole tool according to claim 7, wherein there are three of said bars, slots and flanges.

9. A downhole tool according to claim 7, wherein said tool is an under-reamer and said bars are provided with cutting elements to effect under-reaming when the tool is actuated in a well bore having a pilot hole receiving the tool.

10. A downhole tool according to claim 9, wherein said body is thickened in the region of said slots and bars to support said bars.

11. A downhole tool according to claim 9, wherein said body has fins ahead of said slots having dimensions to match said pilot hole and bear against its surface and stabilise the tool, in use, said fins being provided with a hardened wear surface to minimise wear.

12. A downhole tool according to claim 7, wherein the tool is an adjustable stabiliser, said bars being provided with hardened wear surfaces to minimise wear of the bars, in use.

13. A downhole tool according to claim 1, wherein the tool is an azimuth controller, wherein one or more bars in one or more slots are arranged asymmetrically around the longitudinal axis of the tool.

14. A downhole tool according to claim 13, further comprising one or more static blades.

15. A downhole tool comprising:

a) a body having a longitudinal axis and a body through-bore, the body mounting an actuatable tool;

b) a sleeve actuator having an actuator through-bore and being axially slidable in the body through-bore between a tool actuated position and a tool deactuated position;

c) a mandrel having a mandrel through-bore and being selectively axially slidable in the body through-bore between a tool actuated position, an interlock position and a sleeve-lock position; wherein:

d) an extension of the mandrel is a close sliding fit inside a first end of the sleeve actuator;

e) said first end captivates a lock element;

f) said body has an internal groove positioned so that when said sleeve actuator is in said tool deactuated position, said lock element is aligned with said groove and held in engagement therein by said extension while the mandrel is between its interlock and sleeve-lock positions; and g) said mandrel has an external recess positioned so that, when said mandrel is in said interlock position, said lock element is aligned with said recess, whereupon movement of the mandrel towards said tool actuated position releases said lock element from said groove permitting said sleeve actuator to be moved by the mandrel to said tool actuated position, said mandrel and sleeve actuator being locked together by the body holding said lock element in said recess between said interlock and tool actuated positions of the mandrel.

16. A downhole tool according to claim 15, wherein said lock element is a ball.

17. A downhole tool according to claim 15, wherein said sleeve actuator has ports therethrough which align with jets in the body when the sleeve actuator is in its tool actuated position, whereupon the through-bore of the sleeve actuator is in fluid communication with said jets, and whereby drilling fluid under pressure in said body through-bore is directed into the well bore.

18. A downhole tool according to claim 17, further comprising a valve operated by the sleeve actuator to restrict drilling fluid flow through the tool past said jets.

19. A downhole tool comprising:

a) a body having a longitudinal axis and a body through-bore, the body mounting an actuatable tool;

b) a sleeve actuator having an actuator through-bore and being axially slidable in the body through-bore between a tool actuated position and a tool deactuated position;

c) a mandrel having a mandrel through-bore and being selectively axially slidable in the body through-bore between a tool actuated position, an interlock position and a sleeve-lock position; wherein:

d) first lock means to lock the sleeve actuator with respect to the body in said tool deactuated position and while said mandrel is between said interlock and sleeve-lock positions; and e) second lock means to lock the sleeve actuator with respect to the mandrel and while said mandrel is between said interlock and tool actuated positions.

20. A downhole tool according to claim 19, wherein said first and second means comprise a lock element captivated by the sleeve actuator and located in one of a groove in the body or a recess on the mandrel.

21. A downhole tool according to claim 20, wherein alignment of said groove and recess occurs in said interlock position of the mandrel, which coincides with said tool deactuated position of the sleeve actuator.

22. A downhole tool according to claim 20 wherein said lock element is a ball.

23. A downhole tool comprising:

a) a body mounting an actuatable tool and having a longitudinal axis and a body through-bore, a slot communicating the outside of the body with the body through-bore;

b) a sleeve actuator having an actuator through-bore and being axially slidable in the body through-bore between a tool actuated position and a tool deactuated position;

c) a mandrel having a mandrel through-bore and being selectively axially slidable in the body through-bore between a tool actuated position, an interlock position and a sleeve-lock position; wherein:

d) first lock means to lock the sleeve actuator with respect to the body in said tool deactuated position and while said mandrel is between said interlock and sleeve-lock positions;

e) second lock means to lock the sleeve actuator with respect to the mandrel and while said mandrel is between said interlock and tool actuated positions;

f) a flange on the sleeve actuator extending into said slot and having one of ribs and channels formed on its sides and inclined at an acute angle to the longitudinal axis; and g) a hollow bar slidable with a radial component in the slots, the other of channels and ribs being formed on the bar and corresponding with, and engaged in, said one of said ribs and channels of the flange.

24. A downhole tool according to claim 23, wherein said first and second lock means comprise a lock element captivated by the sleeve actuator and located in one of a groove in the body or a recess on the mandrel.

25. A downhole tool according to claim 24, wherein said lock element is a ball.

26. A downhole tool according to claim 23, wherein seals between said sleeve actuator and body beyond both ends of said slot define, between them and a seal around the bar in the slot, a chamber enclosing lubricating oil.

27. A downhole tool according to claim 23, wherein said sleeve actuator has a port therethrough which aligns with a jet in the body when the sleeve actuator mandrel is in its tool actuated position, whereupon the through-bore of the sleeve actuator is in fluid communication with said jet whereby drilling fluid under pressure in said mandrel through-bore is directed onto the well bore in the region of said bars.

28. A downhole tool according to claim 23, wherein the axis of the slot is radial with respect to said longitudinal axis.

29. A downhole tool according to claim 23, wherein said flange is separate from the sleeve actuator but is locked thereon by circumferential dovetailed slots formed on a sector of the sleeve actuator adjacent an open sector thereof, and corresponding dovetails on the base of said flange engaged with said dovetailed slots of the sleeve actuator.

30. A downhole tool according to claim 29, wherein the tool is assembled by inserting said flange engaged with said bar in said slot so that said dovetails bear against said open sectors of the sleeve actuator, and by rotating said actuator so that said dovetail slots engage said dovetails, means being provided to prevent the sleeve actuator from rotating in the body during use.

31. A downhole tool according to claim 30, wherein said rotation prevention means comprises a pin in the body extending into a slot in the sleeve actuator or mandrel.

32. A downhole tool according to claim 23, wherein there are a plurality of said bars, slots and flanges spaced around the longitudinal axis of the tool.

33. A downhole tool according to claim 32, wherein there are three of said bars, slots and flanges.

34. A downhole tool according to claim 33, wherein the tool is an adjustable stabiliser, said bars being provided with hardened wear surfaces to minimise wear of the bars, in use.

35. A downhole tool according to claim 34, further comprising one or more static blades.

36. A downhole tool according to claim 32, wherein said tool is an under-reamer and said bars are provided with cutting elements to effect under-reaming when the tool is actuated in a well bore having a pilot hole receiving the tool.

37. A downhole tool according to claim 36, wherein said body is thickened in the region of said slots and bars to support said bars.

38. A downhole tool according to claim 36, wherein said body has fins ahead of said slots having dimensions to match said pilot hole and bear against its surface and stabilise the tool, in use, said fins being provided with a hardened wear surface to minimise wear.

39. A downhole tool according to claim 23, wherein the tool is an azimuth controller, wherein one or more bars in one or more slots are arranged asymmetrically around the longitudinal axis of the tool.

40. A downhole tool comprising:

a) a body having a longitudinal axis and a body through-bore, a slot communicating the outside of the body with the body through-bore;

b) a sleeve actuator mandrel having a sleeve actuator mandrel through-bore and being selectively axially slidable in the body through-bore;

c) a bar slidable with a radial component in the slot;

d) a coupling between the sleeve actuator mandrel and the bar to slide the bar with a radial component in the slot on axial sliding of the sleeve actuator mandrel in the body through-bore; and e) seals between said sleeve actuator mandrel and body beyond both ends of said slot, and a seal around the bar in the slot, which seals define between them a chamber enclosing lubricating oil to lubricate said coupling.

* * * * *